US009528459B2

(12) United States Patent
Ikemoto

(10) Patent No.: US 9,528,459 B2
(45) Date of Patent: Dec. 27, 2016

(54) FUEL INJECTION DEVICE

(75) Inventor: Masato Ikemoto, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 190 days.

(21) Appl. No.: 14/407,659

(22) PCT Filed: Jun. 14, 2012

(86) PCT No.: PCT/JP2012/065248

§ 371 (c)(1),
(2), (4) Date: Dec. 12, 2014

(87) PCT Pub. No.: WO2013/186898

PCT Pub. Date: Dec. 19, 2013

(65) Prior Publication Data

US 2015/0136100 A1 May 21, 2015

(51) Int. Cl.

| | |
|---|---|
| ***F02D 41/04*** | (2006.01) |
| ***F02D 41/14*** | (2006.01) |
| *F02D 41/00* | (2006.01) |
| *F02M 61/18* | (2006.01) |

(52) U.S. Cl.

CPC ..... *F02D 41/042* (2013.01); *F02D 41/1446* (2013.01); *F02D 41/0062* (2013.01); *F02M 61/1813* (2013.01); *F02M 2200/05* (2013.01); *F02M 2200/06* (2013.01)

(58) Field of Classification Search

CPC ..... F02D 41/00; F02D 41/04; F02D 41/042; F02D 41/1446; F02D 41/0062; F02M 61/1813; F02M 2200/06; F02M 2200/05; F02M 25/07

See application file for complete search history.

(56) References Cited

U.S. PATENT DOCUMENTS

| | | | | |
|---|---|---|---|---|
| 5,487,421 | A | 1/1996 | Gerber | |
| 5,562,152 | A | 10/1996 | Gerber et al. | |
| 9,284,920 | B2 * | 3/2016 | Leone | F02N 11/0803 |
| 2006/0207565 | A1 | 9/2006 | Nishimura | |
| 2007/0277781 | A1 | 12/2007 | Machida et al. | |
| 2010/0094527 | A1 | 4/2010 | Futonagane et al. | |
| 2012/0139836 | A1 | 6/2012 | Naito et al. | |
| 2013/0084553 | A1 | 4/2013 | Kaneko et al. | |

FOREIGN PATENT DOCUMENTS

| | | | |
|---|---|---|---|
| DE | 10 2010 0146 554 | A1 | 10/2010 |
| EP | 1 555 417 | A2 | 7/2005 |

(Continued)

*Primary Examiner* — Hieu T Vo

(74) *Attorney, Agent, or Firm* — Finnegan, Henderson, Farabow, Garrett & Dunner, LLP

(57) ABSTRACT

A fuel injection device is provided with an injection instruction unit that instructs multiple fuel injection valves that inject fuel into respective multiple cylinders of an engine to perform fuel injection while the engine is stopped. The injection instruction unit instructs the multiple fuel injection valves to perform the fuel injection while the engine is stopped on the basis of at least one of an amount of heat from combustion gas with respect to at least one of the multiple fuel injection valves and an amount of heat radiated therefrom. The injection instruction unit refers to an EGR rate before the engine is stopped and reduces the fuel injection while the engine is stopped as the EGR rate is lower.

6 Claims, 8 Drawing Sheets

(56) References Cited

FOREIGN PATENT DOCUMENTS

| | | | | | |
|---|---|---|---|---|---|
| EP | 2 071 164 | A1 | | 6/2009 | |
| EP | 2 325 468 | A1 | | 5/2011 | |
| JP | 7-181877 | | | 7/1995 | |
| JP | 8-10908 | | | 1/1996 | |
| JP | 9-32616 | | | 2/1997 | |
| JP | 9-203363 | | | 8/1997 | |
| JP | 2000-104610 | | | 4/2000 | |
| JP | 2005-232997 | | | 9/2005 | |
| JP | 2006-258022 | | | 9/2006 | |
| JP | 20071 32170 | | | 12/2007 | |
| JP | 2009-2229 | | | 1/2009 | |
| JP | 2010-255462 | | | 11/2010 | |
| JP | 2012-21455 | | | 2/2012 | |
| JP | 2015094325 | A | * | 5/2015 | ..... F02M 25/07 |

* cited by examiner

FUEL INJECTION DEVICE

TECHNICAL FIELD

The present invention relates to a fuel injection device.

BACKGROUND ART

Conventionally, it is known that fuel injection is performed while the engine is stopped in order to cause fuel to be deposited around nozzle holes. Fuel injection that is performed while the engine is stopped is intended to avoid freezing of condensed water and the occurrence of corrosion around the nozzle holes due to deposition of condensed water around the nozzle holes. The proposal to deposit fuel around the nozzle holes is described in Patent Document 1, for example. More specifically, the proposal estimates whether nozzle hole portions at the tip of the fuel injection valve are frozen on the basis of the ambient temperature and the operation time from the engine start to stop, and determines whether fuel should be injected while the engine is stopped on the basis of the estimation result.

PRIOR ART DOCUMENTS

Patent Documents

[Patent Document 1] Japanese Laid-Open Patent Publication No. 9-32616

SUMMARY OF THE INVENTION

Problems to be Solved by the Invention

However, when fuel is injected while the engine is stopped, fuel deposited around the nozzle holes may be a cause of abnormal combustion in the next engine start or a cause of smoke emissions. The fuel that is injected while the engine is stopped is discharged without being burned. Thus, as the amount of injection increases, the fuel economy and exhaust emissions are degraded. Therefore, it is desired to have the number of times of fuel injection that is performed while the engine is stopped as small as possible and furthermore to reduce the amount of fuel injected within a range in which the deposition of condensed water around the nozzle holes can be avoided. From this viewpoint, the proposal disclosed in the above-described Patent Document 1 has room for improvement.

A fuel injection device disclosed in the specification aims to reduce the number of times of fuel injection that is performed while the engine is stopped within a range in which the deposition of condensed water around the nozzle holes can be reduced and to reduce the amount of fuel injected accordingly.

Means for Solving the Problems

In order to solve the problems, a fuel injection device disclosed in the specification is provided with an injection instruction unit that instructs multiple fuel injection valves that inject fuel into respective multiple cylinders of an engine to perform fuel injection while the engine is stopped, the injection instruction unit instructing the multiple fuel injection valves to perform the fuel injection while the engine is stopped on the basis of at least one of an amount of heat from combustion gas with respect to at least one of the multiple fuel injection valves and an amount of heat radiated therefrom.

When attention is focused on deposition of condensed water on the tip of the fuel injection valve, it is conceivable that as the amount of heat received from combustion gas is larger, the tip temperature of the fuel injection valve is higher. As the tip temperature of the fuel injection valve increases, condensed water is generated in a portion of the fuel injection valve that is other than the tip and has a relatively low temperature. It is conceivable that when the amount of heat radiated increases, the tip temperature of the fuel injection valve decreases. When the tip temperature of the fuel injection valve decreases, condensed water is generated on the fuel injection valve and is more than likely to be deposited around nozzle holes. Thus, it is determined whether fuel injection should be performed while the engine is stopped on the basis of at least one of the amount of heat received from the combustion gas and the amount of heat radiated. It is thus possible to reduce the fuel injection without condensed water being deposited around the tip of the fuel injection valve. That is, it is possible to accurately determine whether the fuel injection is required and to avoid unneeded fuel injection and reduce the number of times of fuel injection and to inject an appropriate amount of fuel. As a result, it is possible to suppress degradation of fuel economy and exhaust emissions.

The injection instruction unit instructs the multiple fuel injection valves to perform the fuel injection while the engine is stopped on the basis of at least one of an amount of heat from combustion gas with respect to at least one of the multiple fuel injection valves and an amount of heat radiated therefrom. As to the other fuel injection valves, it may be determined whether the fuel injection is required by referring to the determination made regarding the fuel injection valve for which it is determined whether the fuel injection is required while the engine is stopped. As to the other fuel injection valves, it is also possible to determine whether the fuel injection is required for each of the other fuel injection valves separately. That is, when the determination as to whether the fuel injection should be performed while the engine is stopped is made for each of the fuel injection valves, different fuel injection valves may have respective different determination making methods.

In the engine with multiple cylinders, observed are differences in the tip temperature between the fuel injection valves that inject fuel into the respective cylinders. Thus, in a certain state of the engine, there is a mixture of a fuel injection valve by which the fuel injection is required while the engine is stopped and another fuel injection valve by which the fuel injection is not required while the engine is stopped. Even in such a state, by determining whether the fuel injection is required while the engine is stopped for each of the fuel injection valves, it is possible to reduce the number of times of fuel injection in the whole device.

The injection instruction unit refers to an EGR rate before the engine is stopped and reduces the fuel injection while the engine is stopped as the EGR rate is lower.

It is conceivable that moisture of condensed water and strong acid that cause corrosion around the nozzle holes of the fuel injection valves result from the introduction of EGR (Exhaust Gas Recirculation). It is thus conceivable that as the EGR rate is high, corrosion around the nozzle holes due to condensed water is likely to progress. In contrast, it is conceivable that as the EGR rate is low, it is hard for corrosion around the nozzle holes by the condensed water to progress and the requirement for fuel injection as a measure for corrosion is low. Therefore, by performing a control to reduce the fuel injection while the engine is stopped as the EGR rate is lower, it is possible to avoid unneeded fuel injection while the engine is stopped and to suppress degradation of fuel economy and exhaust emissions.

The injection instruction unit may estimate a tip temperature of the fuel injection valve from the amount of heat received from the combustion gas and the amount of heat radiated, and may instruct the multiple fuel injection valves to perform the fuel injection while the engine is stopped on the basis of the tip temperature.

As described above, the amount of heat received and the amount of heat radiated are factors that affect the tip temperatures of the fuel injection valves. Thus, threshold values are respectively defined for the amount of heat received and the amount of heat radiated, and the determination as to whether fuel should be injected while the engine is stopped may be made on the basis of the threshold values. For example, by referring to only the threshold value for the amount of heat received, it may be determined whether the fuel injection should be performed while the engine is stopped. It is also possible to determine whether fuel should be injected while the engine is stopped by referring to only the threshold value for the amount of heat radiated. Further, it is also possible to determine whether the fuel injection should be performed while the engine is stopped by combining the threshold value for the amount of heat received and the threshold value for the amount of heat radiated and determining whether the current state is within a zone defined by both the threshold values (AND condition). Furthermore, by estimating the tip temperature of the fuel injection valve from the amount of heat received from combustion gas and the amount of heat radiated and defining a threshold value for the tip temperature, it is also possible to determine whether fuel should be injected while the engine is stopped on the basis of the threshold value. It is thus possible to more appropriately determine whether fuel should be injected while the engine is stopped. Thus, it is possible to avoid unneeded fuel injection while the engine is stopped and to suppress degradation of fuel economy and exhaust emissions.

The injection instruction unit may instruct the multiple fuel injection valves to perform the fuel injection while the engine is stopped on the basis of the tip temperature and the EGR rate. As described above, EGR gas includes moisture of condensed water and strong acid that cause corrosion around the nozzle holes of the fuel injection valve. Thus, by considering the tip temperature of the fuel injection valve and the EGR rate, it is possible to accurately determine whether the fuel injection is required while the engine is stopped.

When estimating the tip temperature of each of the multiple fuel injection valves, the injection instruction unit corrects estimated values of the tip temperatures of the fuel injection valves so that estimated values of the tip temperatures of the fuel injection valves that inject fuel into cylinders located at ends of a line in which the multiple cylinders are arranged are lower than those of the tip temperatures of the fuel injection valves that inject fuel into cylinders located closer to a center of the line.

Generally, in the engine with multiple cylinders, these cylinders are arranged in line. For example, an in-line four cylinder engine has four cylinders of #1 cylinder through #4 cylinder that are arranged in line. In this case, each of #1 and #4 cylinders located at the ends does not have any cylinder at one side, which is open. Thus, #1 and #4 cylinders have a low temperature, as compared to #2 and #3 cylinders, each of which has cylinders respectively at both sides. Hence, in estimation of the tip temperature of each fuel injection valve, the arrangement of cylinders that affects the tip temperatures is taken into consideration, whereby the estimation accuracy can be improved. For a V-type engine or horizontally-opposed cylinder engine, the arrangement of cylinders may be considered for each bank.

The injection instruction unit may refer to an in-cylinder gas temperature in one of the cylinders into which the fuel injection valve injects fuel, as a value that represents the amount of heat received from the combustion gas. Also, the injection instruction unit refers to a water temperature as a value that represents the amount of heat radiated.

Effects of the Invention

According to the present invention, it is possible to reduce the number of times of fuel injection that is performed while the engine is stopped within a range in which the deposition of condensed water around the nozzle holes can be reduced and to reduce the fuel injection amount accordingly.

MODES FOR CARRYING OUT THE INVENTION

Figure 1:
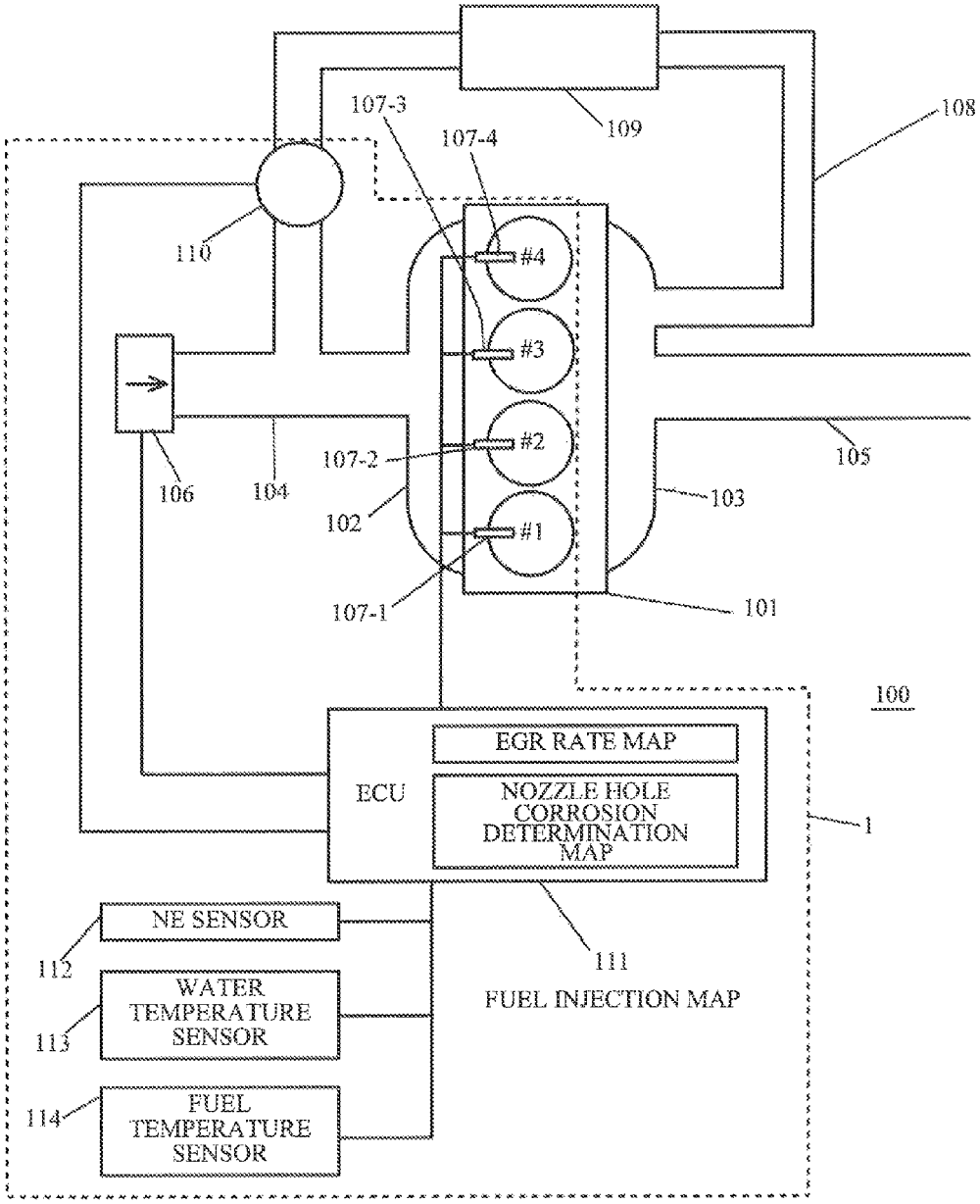
FIG. 1 is a schematic diagram of a structure of an engine into which a fuel injection device is incorporated.

A description is given of embodiments of the invention in conjunction with the accompanying drawings. In the drawings, it is to be noted that the figures may be illustrated in such a way that the dimensions and ratios of parts do not perfectly correspond to the actual ones. Furthermore, minor parts may be omitted for the convenience of illustration in some drawings.

Embodiments

Figure 2:
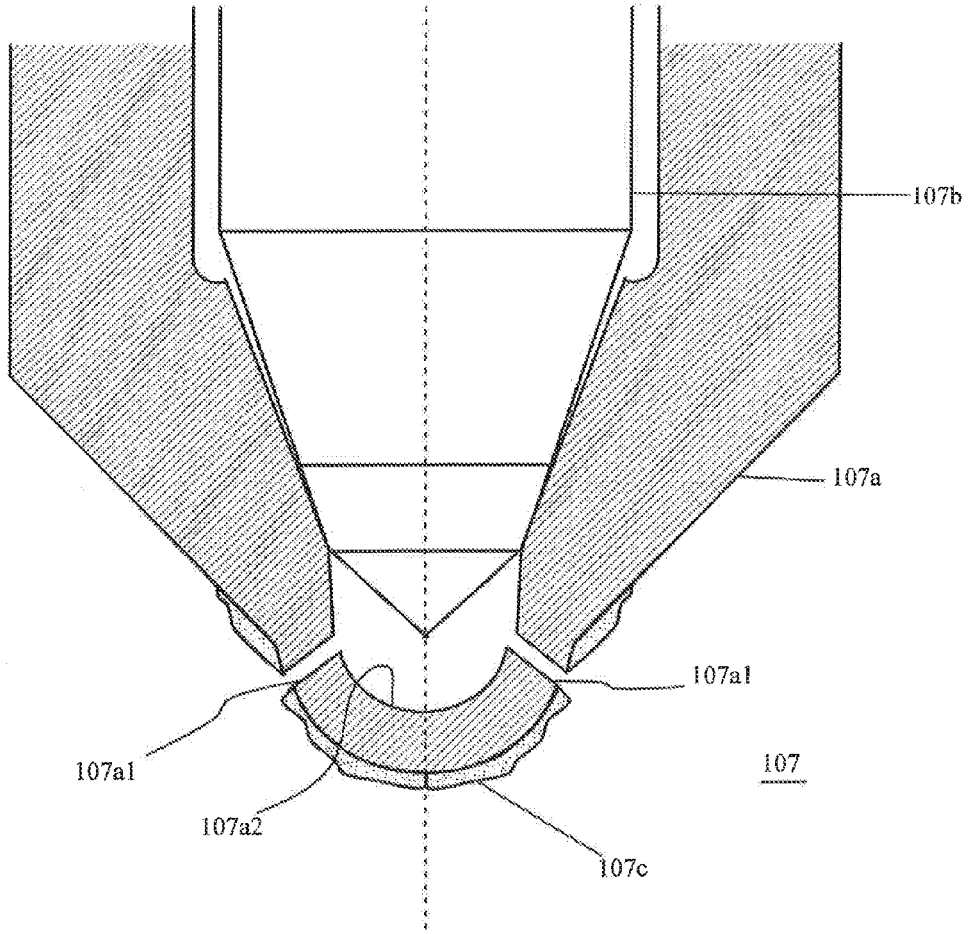
FIG. 2 is a schematic diagram of a tip of a fuel injection valve.

FIG. 1 is a schematic diagram of a structure of an engine 100 into which a fuel injection device 1 is incorporated in accordance with an embodiment FIG. 2 is a schematic diagram of a tip of a fuel injection valve 107.

The engine 100 employs in-cylinder injection, and is more specifically, a diesel engine. The engine 100 has four cylinders. The engine 100 has an engine body 101, which is provided with four cylinders of #1 cylinder~#4 cylinder. The fuel injection device 1 is incorporated into the engine 100. The fuel injection device 1 has #1 fuel injection valve 107-1~#4 fuel injection valve 107-4 respectively provided for #1 cylinder~#4 cylinder. More specifically, the #1 fuel injection valve 107-1 is attached to #1 cylinder, the #2 fuel injection valve 107-2 is attached to #2 cylinder, the #3 fuel injection valve 107-3 is attached to #3 cylinder, and the #4 fuel injection valve 107-4 is attached to #4 cylinder.

The engine 100 is provided with an intake manifold 102 and an exhaust manifold 103 attached to the engine body 101. An intake pipe 104 is connected to the intake manifold 102. An exhaust pipe 105 is connected to the exhaust manifold 103 to which one end of an EGR path 108 is connected. The other end of the EGR path 108 is connected to the intake pipe 104. An EGR cooler 109 is provided in the EGR path 108. Furthermore, an EGR valve 110, which controls the flow state of exhaust gas, is provided in the EGR path 108. An airflow meter 106 is connected to the intake pipe 104. The airflow meter 106 is electrically connected to an ECU 111. The fuel injection valves 107-*i* (i indicates the cylinder number), that is, #1 fuel injection valve 107-1~#4 fuel injection valve 107-4 are electrically connected to the ECU 111. The ECU 111 functions as an injection instruction unit that gives #1 fuel injection valve 107-1~#4 fuel injection valve 107-4 respective instructions to inject fuel while the engine is stopped.

To the ECU 111, electrically connected are an NE sensor 112 that measures the engine speed, a water temperature sensor 113 that measures the temperature of cooling water, and a fuel temperature sensor 114 that measures the temperature of fuel. The ECU 111 not only functions as the injection instruction unit but performs various controls for engine peripherals.

Referring to FIG. 2, the fuel injection valve 107 has a nozzle body 107*a* in which a needle valve 107*b* is slidably held. Nozzle holes 107*a*1 are formed at the tip of the nozzle body 107*a*. A suck room 107*a*2 is formed inside the tip of the nozzle body 107*a*. If condensed water is deposited on the tip of the nozzle body 107*a*, corrosion may occur. If the periphery of the nozzle holes 107*a*1 corrodes, the size of the nozzle holes 107*a*1 may change. A change of the nozzle hole size affects the amount of fuel injected. Hence, when fuel is injected while the engine is stopped, the suck room 107*a*2 is full of fuel, or a deposit 107*c* that adheres to the tip of the fuel injection valve 107 is wetted by fuel. By this, the deposition of condensed water is suppressed and corrosion is thus suppressed.

Figure 3:
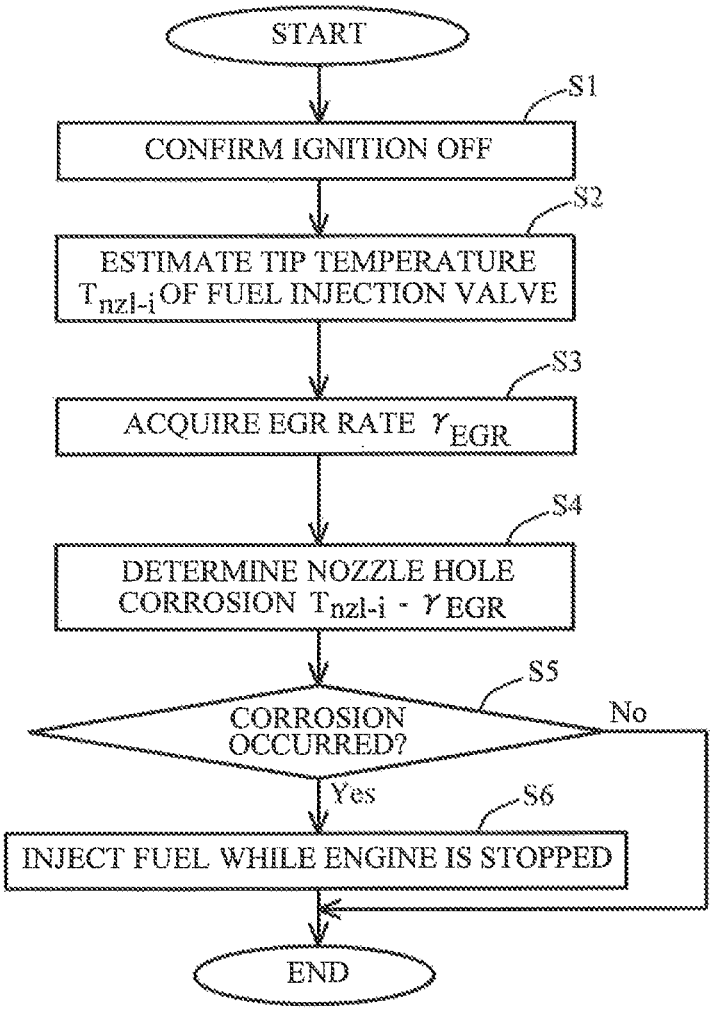
FIG. 3 is a flowchart of an example of a control of the fuel injection device.

A description is now given, with reference to a flowchart of FIG. 3, of an example of a control by the fuel injection device 1 for the above purpose. The control by the fuel injection device 1 is responsibly performed by the ECU 111.

First, in step S1, it is confirmed that an ignition of the engine 100 is turned off. In step S2 that is performed subsequent to step S1, a tip temperature Tnzl-i of the fuel injection valve is estimated. The suffix i of the tip temperature Tnzl-i indicates the cylinder number. That is, the tip temperature Tnzl is calculated as estimated values Tnzl-1~Tnzl-4 for the respective cylinders.

More specifically, the tip temperature Trizl-i is calculated as a value obtained by subtracting the amount of heat radiated from the amount of heat received at the tip of the fuel injection valve 107-*i*. The tip temperature Tnzl-i is calculated by an exemplary expression (1) described below:

$$\text{Tnzl-}i = ki \times (a \cdot NE + b \cdot IT + c \cdot TQ + d \cdot Tw + e \cdot Tf + g) \quad (1)$$

NE: engine speed IT: injection timing TQ: torque
Tw: water temperature Tf: fuel temperature
ki: inter-cylinder correction coefficient
a, b, c, d (<0), e(<0), g: compatibility coefficient The inter-cylinder correction coefficient ki is intended to correct differences in temperature between #1 cylinder through #4 cylinder arranged in line and to thus estimate the tip temperatures of the fuel injection valves 107-1~107-4 accurately. Due to the introduction of the inter-cylinder correction coefficient ki, the estimated values of the tip temperatures of the #1 fuel injection valve 107-1 and the #4 fuel injection valve 107-4 respectively located at ends are made smaller than the estimated values of the tip temperatures of the #2 fuel injection valve 107-2 and the #3 fuel injection valve 107-3 located closer to the center. More specifically, k1 is set equal to 0.95 in estimation of the tip temperature of the #1 fuel injection valve 107-1. In estimation of the tip temperature of the #2 fuel injection valve 107-2, k2 is set equal to 1.1. In estimation of the tip temperature of the #3 fuel injection valve 107-3, k3 is set equal to 1.1. In estimation of the tip temperature of the #4 fuel injection valve 107-4, k4 is set equal to 0.9. By the above-described setting of ki, the estimated values of the tip temperatures in the cylinders located at the ends are made smaller than the estimated values of the tip temperatures in the cylinders located closer to the center, whereby the accurate estimated values that reflect the actual temperatures are available.

The engine speed NE in expression (1) is acquired by the NE sensor 112. The water temperature Tw is acquired by the water temperature sensor 113. The fuel temperature Tf is acquired by the fuel temperature sensor 114.

In expression (1), (a·NE+b·IT+c·TQ) calculates the in-cylinder gas temperature as a value indicating the amount of heat received. Item d·Tw calculates the cooling water temperature as a value indicating the amount of heat radiated. Item e·Tf calculates the fuel temperature as a value indicating the amount of heat radiated. The compatibility coefficients d and e are both smaller than 0 (<0), and function to reduce the tip temperature Tnzl-i. If a correlation between the fuel temperature and the water temperature is found out, the item e·Tf may be omitted by setting the compatibility coefficient d so as to additionally include a change of the fuel temperature Tf. The compatibility coefficients a, b, c, d, e and g are appropriately determined by considering the specification of the engine 100, the difference between the individual engines and reflecting experimental results and simulation results.

Figure 5:
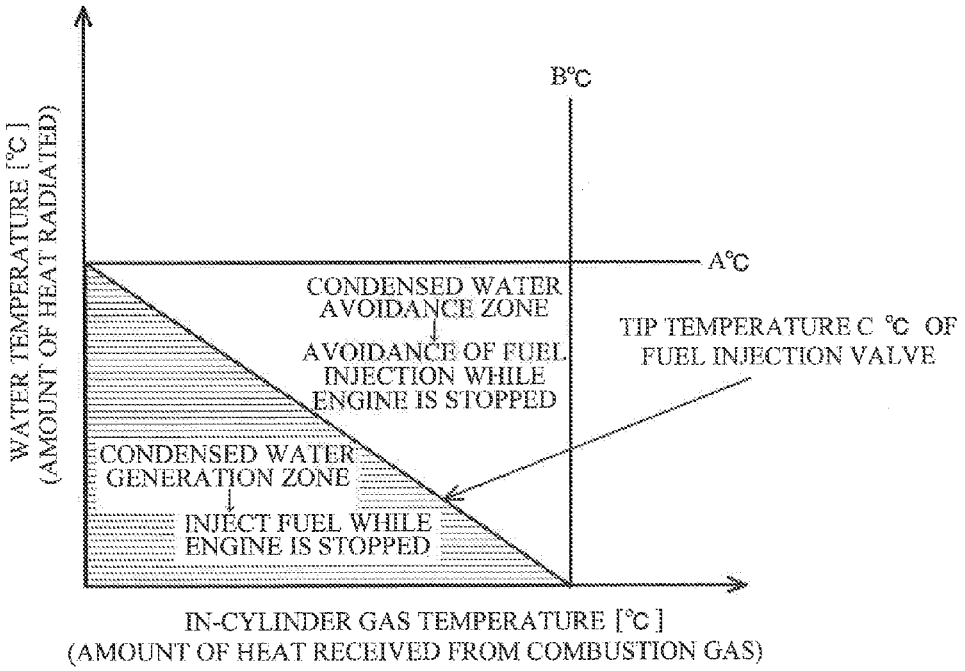
FIG. 5 is an example of a graph that indicates a relationship between water temperature and tip temperature of a fuel injection valve and a relationship between in-cylinder gas temperature and tip temperature of the fuel injection valve.

Referring to FIG. 5, there is illustrated a threshold value C ° C. for the tip temperature of the fuel injection valve in which the vertical axis denotes the water temperature and the horizontal axis denotes the in-cylinder gas temperature. The threshold value C ° C. for the tip temperature of the fuel injection valve is obtained by subtracting the water temperature from the in-cylinder gas temperature. Thus, even for the same water temperature (the amount of heat radiated), entry into a condensed water avoidance zone is possible when the in-cylinder gas temperature (the amount of heat received) is high, whereby the fuel injection can be avoided while the engine is stopped. In contrast, even for the same in-cylinder gas temperature (the amount of heat received), entry into the condensed water avoidance zone is possible when the water temperature (the amount of heat radiated) is high, whereby the fuel injection can be avoided while the engine is stopped. As described above, the tip temperature Tnzl-i of the fuel injection valve is calculated by the sum of the amount of heat received and the amount of heat radiated. That is, a determination as to whether condensed water is generated is not made by an AND condition on the amount of heat received and the amount of heat radiated. As a result, a determination as to whether fuel should be injected while the engine is stopped is made more accurately.

Tnzl-1~Tnzl-4 are respectively calculated by expression (1). Also, another exemplary way may be employed in which the tip temperature of a representative one of the fuel injection values is calculated by expression (1), and the tip temperatures Tnzl-n of the other fuel injection values are estimated on the basis of the above estimated tip temperature. For example, the tip temperature Tnzl-1 of the #1 fuel injection valve 17-1 is estimated, and the tip temperatures Tnzl-i of the other fuel injection valves are calculated on the basis of a correlation between the estimated value and the tip temperatures of the other fuel injection valves, which correlation is prepared beforehand.

Figure 4:
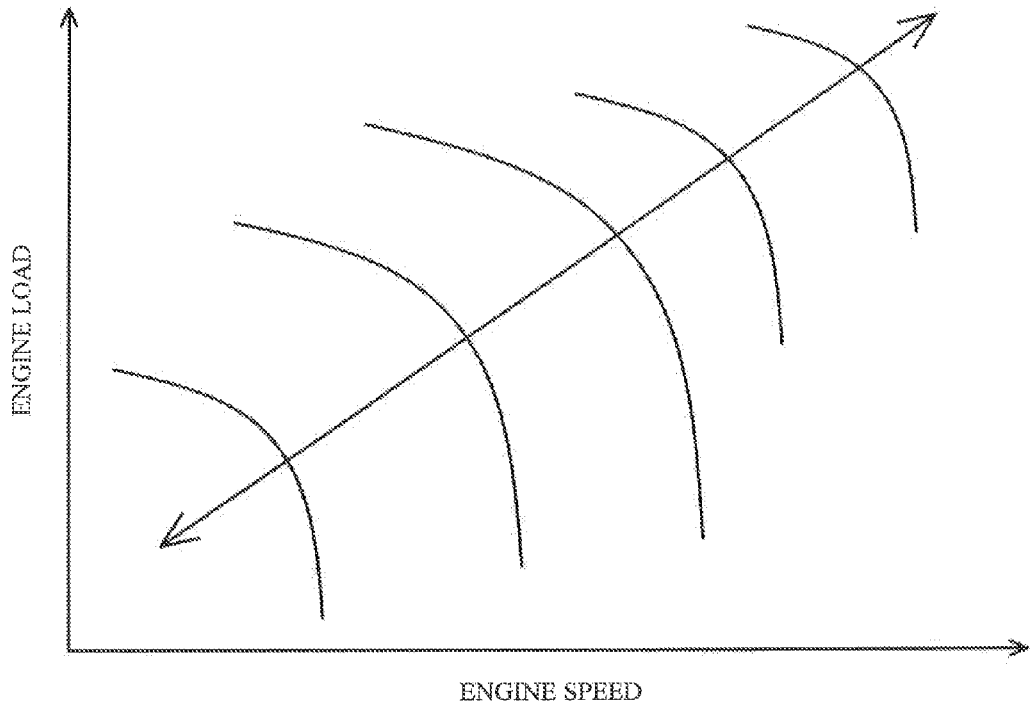
FIG. 4 is an example of a map for calculating the EGR rate.

In step S3 that is performed to follow step S2, an EGR rate $\gamma_{EGR}$ before the engine 100 is stopped is acquired. The EGR rate $\gamma_{EGR}$ is determined by an exemplary map illustrated in FIG. 4. The ECU 111 stores the value of the EGR rate $\gamma_{EGR}$ just prior to the engine stop in order to spontaneously determine the EGR rate $\gamma_{EGR}$.

Figure 6:
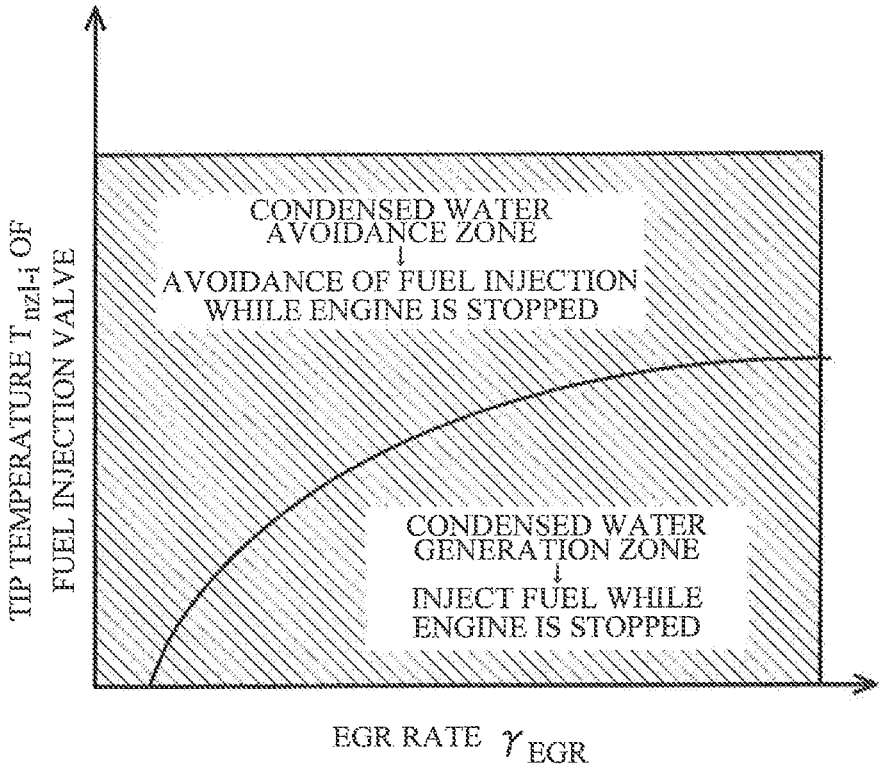
FIG. 6 is an example of a map that determines whether fuel injection should be performed while the engine is stopped on the basis of the relationship between the tip temperature of the fuel injection valve and the EGR rate.

In step S4 that is performed to follow step S3, a nozzle hole corrosion determination is made. The nozzle hole corrosion determination is made on the basis of the tip temperatures Tnzl-i and the EGR rate $\gamma_{EGR}$. FIG. 6 illustrates an example of a map for determining whether the fuel injection should be performed while the engine is stopped on the basis of a relationship between the tip temperature of the fuel injection valve 107-*i* and the EGR rate $\gamma_{EGR}$. Referring to FIG. 6, the ECU 111 performs a control to reduce the fuel injection while the engine is stopped as the EGR rate $\gamma_{EGR}$ is lower. This considers that corrosion around the nozzle holes has almost no occurrence when the EGR rate $\gamma_{EGR}$ is low. More specifically, even for the same tip temperature Tnzl-i, entry into the condensed water avoidance zone is easier as the EGR rate $\gamma_{EGR}$ is lower. As a result, the fuel injection while the engine is stopped is more likely to be avoided, and the frequency of fuel injection while the engine is stopped is reduced. As described above, the nozzle hole corrosion determination is made on the basis of the tip temperature Tnzl-i and the EGR rate $\gamma_{EGR}$; whereby the precision is improved, and therefore, the determination as to whether the fuel injection is required while the engine is stopped is made accurately. Thus, unneeded fuel injection can be avoided and degradation of fuel economy and exhaust emissions can be suppressed. The nozzle hole corrosion determination is made for each of the fuel injection valves.

In step S5 that is performed to follow step S4, it is determined whether a condition for the occurrence of corrosion is met on the basis of the calculation result obtained at step S4. The process of step S5 is carried out for each of the fuel injection valves 107-*i*. The process is ended (END) for the fuel injection valve 107-*i* for which the determination result of step S5 is No. In contrast, for the fuel injection valve 107-*i* for which the determination result of step S5 is Yes, the control proceeds to step S6 in which fuel is injected while the engine is stopped.

Figure 7:
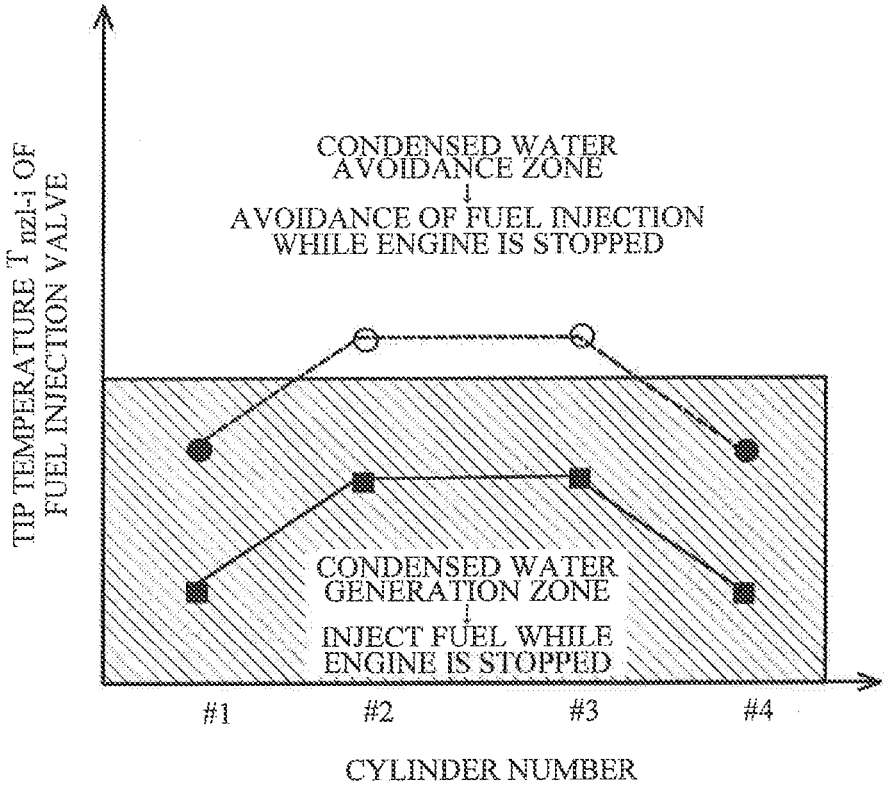
FIG. 7 is an example of a graph that indicates a difference in the tip temperature between fuel injection valves.

FIG. 7 is an example of a graph that indicates a difference in the tip temperature Tnzl-i of the fuel injection valve between the cylinders. In FIG. 7, there are illustrated tip temperatures Tnzl-i under two different conditions. Even under any of the conditions, the temperatures in #2 and #3 cylinders located closer to the center are higher than those in #1 and #4 cylinders. Under the condition indicated by a solid line, the tip temperatures Tnzl-i of all the cylinders are located within a condensed water occurrence zone indicated with hatching, and fuel is injected into all the cylinders while the engine is stopped, in contrast, under the condition indicated by a broken line, the tip temperatures of #2 and #3 cylinders are located within a condensed water avoidance zone, while the tip temperatures of only #1 and #4 cylinders are located in the condensed water occurrence zone. Thus, fuel is injected by only the #1 fuel injection valve 107-1 and the #4 fuel injection valve 107-4 while the engine is stopped.

The fuel injection is performed while the engine is stopped as described above, and it is thus possible to avoid the deposition of condensed water on the tip of the fuel injection valve 107-*i* for which it is determined that condensed water is deposited, specifically, the deposition around the nozzle holes and to avoid corrosion.

The fuel injection device 1 of the present embodiment accurately determines whether condensed water is deposited on the tips of the fuel injection valves, in other words, whether fuel injection is required while the engine is stopped. Thus, it is possible to reduce the number of times of fuel injection performed while the engine is stopped within the range in which the deposition of condensed water around the nozzle holes of the fuel injection valve 107-*i* can be suppressed and to reduce the amount of fuel injected. It is thus possible to suppress abnormal combustion, smoke emissions and degradation of fuel economy and exhaust emissions. The fuel injection that is performed while the engine is stopped may dilute oil and damage the combustion chamber in a specific piston position with the engine being stopped. However, according to the embodiment, since the frequency of fuel injection that is performed while the engine is stopped is reduced, the possibility of those issues can be reduced.

Figure 8:
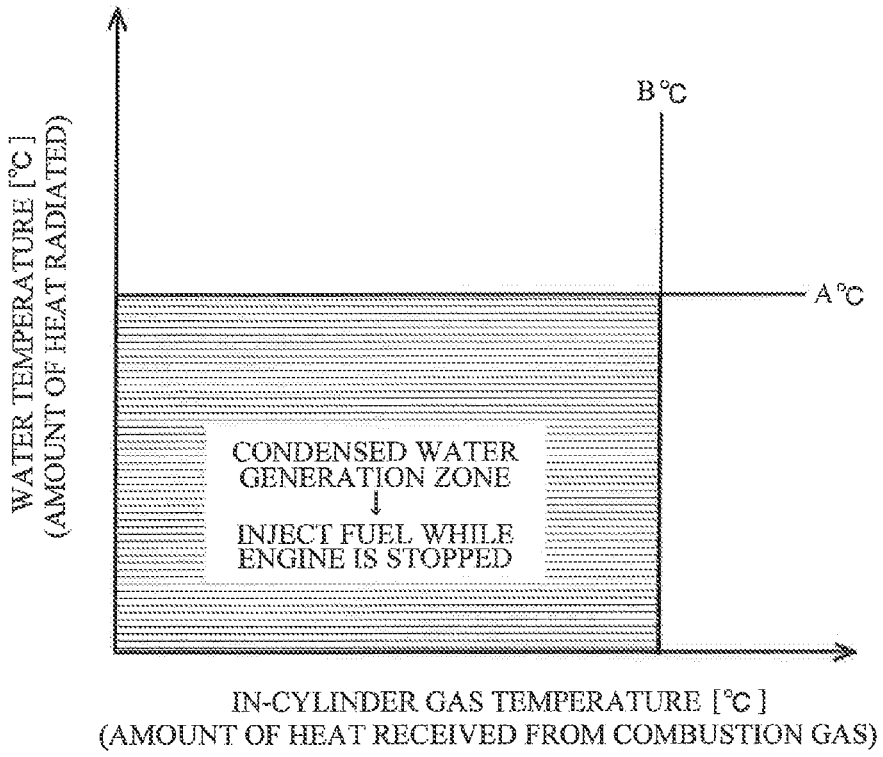
FIG. 8 is an example of a graph that indicates a zone in which fuel injection is performed while the engine is stopped, which zone is defined by a threshold value for water temperature and a threshold value for in-cylinder gas temperature.

Now, a description is given, with reference to FIG. 8, of another example of making a determination as to whether the fuel injection is required while the engine is stopped. Referring to FIG. 8, A ° C. is set as a threshold value for the water temperature (the amount of heat radiated), and B ° C. is set as a threshold value for the in-cylinder gas temperature (the amount of heat received). These threshold values may be used alone, or may be used as an AND condition thereon. When only the threshold value A ° C. for the water temperature is used, fuel is injected while the engine is stopped irrespective of whatever ° C. the in-cylinder gas temperature is. When only the threshold value B ° C. for the in-cylinder gas temperature is used, fuel is injected while the engine is stopped irrespective of whatever ° C. the water temperature is when the in-cylinder gas temperature is equal to or lower than B ° C.

Figure 9:
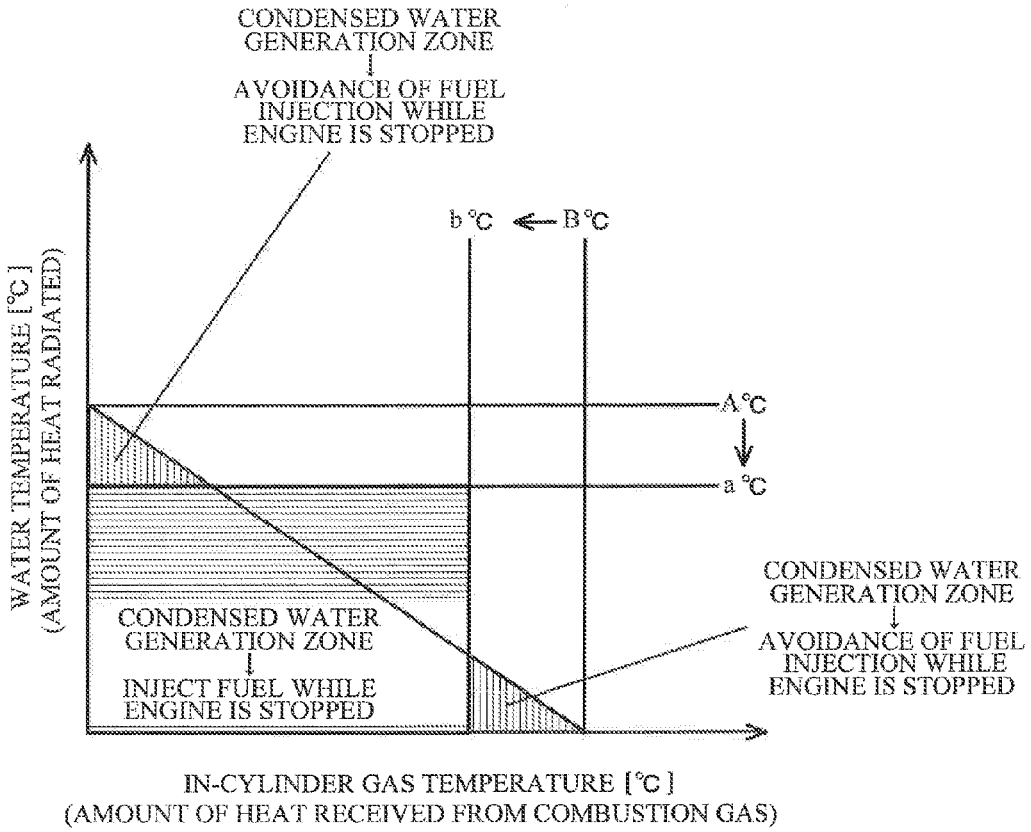
FIG. 9 is an example of a graph that indicates the zone in which fuel injection is performed while the engine is stopped when the threshold value for water temperature and the threshold value for in-cylinder gas temperature are changed.

When the threshold value A ° C. for the water temperature and the threshold value B ° C. for the in-cylinder gas temperature are used as the AND condition, fuel is injected while the engine is stopped if these temperatures are located within a zone with hatching in FIG. 8. Even when the AND condition on the threshold value A ° C. for the water temperature and the threshold value B ° C. (for the in-cylinder gas temperature is used, it is possible to obtain an effect to a certain extent in the accurate estimation of the occurrence of condensed water. When the fuel injection zone while the engine is stopped in the graph of FIG. 5 and that in the graph of FIG. 8 are compared with each other, the zone in the graph of FIG. 5 is narrower. That is, the frequency of fuel injection while the engine is stopped is much reduced in the graph of FIG. 5, as compared to that in FIG. 9. Referring to FIG. 9, there is illustrated an example in which the threshold value A ° C. for the water temperature is set to a ° C., (a ° C.<A ° C.) and the threshold value B ° C. for the in-cylinder gas temperature is set to b ° C. (b ° C.<B ° C.) in order to reduce the frequency of fuel injection while the engine is stopped. According to this example, it is possible to reduce the zone in which the fuel injection is performed while the engine is stopped. In contrast, there is a zone in which the fuel injection that is performed while the engine is stopped is avoided even within the condensed water occurrence zone. In such a zone, there is a possibility that condensed water is deposited and corrosion occurs.

With the above in mind, it is more effective to determine whether the fuel injection is required while the engine is stopped on the basis of the tip temperature Tnzl-i calculated by considering the amount of heat received and the amount of heat radiated with respect to the fuel injection valve 107-*i*.

The above-described embodiments are just examples for carrying out the invention. The present invention is not limited to those but it is apparent from the above description that the above embodiments are varied variously within the scope of the present invention and that other various embodiments may be made within the scope of the present invention.

DESCRIPTION OF REFERENCE NUMERALS

1 Fuel injection device
100 Engine
101 Engine body
102 Intake manifold
103 Exhaust manifold
104 Intake pipe
105 Exhaust pipe
107-1~107-4 Fuel injection valves

The invention claimed is:

1. A fuel injection device provided with an injection instruction unit that instructs multiple fuel injection valves that inject fuel into respective multiple cylinders of an engine to perform fuel injection while the engine is stopped, the injection instruction unit instructing the multiple fuel injection valves to perform the fuel injection while the engine is stopped on the basis of at least one of an amount of heat from combustion gas by at least one of the multiple fuel injection valves and an amount of heat radiated therefrom, wherein the injection instruction unit refers to an EGR rate before the engine is stopped and reduces the fuel injection while the engine is stopped as the EGR is lower.

2. The fuel injection device according to claim 1, wherein the injection instruction unit estimates a tip temperature of the fuel injection valve from the amount of heat received from the combustion gas and the amount of heat radiated, and instructs the multiple fuel injection valves to perform the fuel injection while the engine is stopped on the basis of the tip temperature.

3. The fuel injection device according to claim 2, wherein the injection instruction unit instructs the multiple fuel injection valves to perform the fuel injection while the engine is stopped on the basis of the tip temperature and the EGR rate.

4. The fuel injection device according to claim 2, wherein when estimating the tip temperature of each of the multiple fuel injection valves, the injection instruction unit corrects estimated values of the tip temperatures of the fuel injection valves so that estimated values of the tip temperatures of the fuel injection valves that inject fuel into cylinders located at ends of a line in which the multiple cylinders are arranged are lower than those of the tip temperatures of the fuel injection valves that inject fuel into cylinders located closer to a center of the line.

5. The fuel injection device according to claim 1, wherein the injection instruction unit refers to an in-cylinder gas temperature in one of the cylinders into which the fuel injection valve injects fuel, as a value that represents the amount of heat received from the combustion gas.

6. The fuel injection device according to claim 1, wherein the injection instruction unit refers to a water temperature as a value that represents the amount of heat radiated.

* * * * *